US009375958B2

(12) United States Patent
Ohmura et al.

(10) Patent No.: US 9,375,958 B2
(45) Date of Patent: Jun. 28, 2016

(54) IMAGE FORMING APPARATUS AND ASSEMBLY SYSTEM OF IMAGE FORMING APPARATUS

(71) Applicants: Yuuji Ohmura, Ibaraki (JP); Yasushi Hashimoto, Ibaraki (JP); Yoshikane Matsumoto, Kanagawa (JP)

(72) Inventors: Yuuji Ohmura, Ibaraki (JP); Yasushi Hashimoto, Ibaraki (JP); Yoshikane Matsumoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/484,671

(22) Filed: Sep. 12, 2014

(65) Prior Publication Data

US 2014/0375741 A1 Dec. 25, 2014

Related U.S. Application Data

(60) Continuation of application No. 13/838,149, filed on Mar. 15, 2013, now Pat. No. 8,870,328, which is a division of application No. 12/582,439, filed on Oct. 20, 2009, now Pat. No. 9,259,947.

(30) Foreign Application Priority Data

Oct. 31, 2008 (JP) ..... 2008-281845

(51) Int. Cl.
*B41J 2/205* (2006.01)
*B41J 2/01* (2006.01)
(Continued)

(52) U.S. Cl.
CPC .. *B41J 13/08* (2013.01); *B41J 2/01* (2013.01); *B41J 2/175* (2013.01); *B41J 2/1752* (2013.01);
(Continued)

(58) Field of Classification Search
CPC ..... B41J 11/007; B41J 11/008; B41J 2/02135
USPC ..... 347/15, 101, 104–106, 153, 172, 215, 347/262; 271/3.18, 3.2, 272; 346/44, 107.6
See application file for complete search history.

(56) References Cited

U.S. PATENT DOCUMENTS 6,189,684 B1 2/2001 Greive
6,309,046 B1 10/2001 Izawa et al.
(Continued)

FOREIGN PATENT DOCUMENTS

DE 19856372 A1 7/1999
DE 10152464 A1 5/2002
(Continued)

OTHER PUBLICATIONS

Mar. 3, 2010 European search report in connection with counterpart European patent application No. 09 25 2472.
(Continued)

*Primary Examiner* — Kaveh C Kianni
*Assistant Examiner* — Hung Lam
(74) *Attorney, Agent, or Firm* — Cooper & Dunham LLP

(57) ABSTRACT

An image forming apparatus includes a sheet feed conveying unit having an outlet for a recording medium on one side; at least one image forming unit having an inlet for the recording medium on one side and an outlet for the recording medium on the other side; and a sheet eject conveying unit having an inlet for the recording medium on one side, wherein the sheet feed conveying unit, the image forming unit, and the sheet eject conveying unit are arranged along a conveying direction of the recording medium; the outlet of the sheet feed conveying unit matches the inlet of the image forming unit; the outlet of the image forming unit matches the inlet of the sheet eject conveying unit; and the sheet feed conveying unit, the image forming unit, and the sheet eject conveying unit are connected to each other in a separable manner.

11 Claims, 20 Drawing Sheets

(51) Int. Cl.

| | |
|---|---|
| ***B41J 3/407*** | (2006.01) |
| ***B41J 2/385*** | (2006.01) |
| ***B41J 13/08*** | (2006.01) |
| ***B41J 2/175*** | (2006.01) |
| ***B41J 3/54*** | (2006.01) |
| ***B41J 29/02*** | (2006.01) |
| ***B65H 23/04*** | (2006.01) |
| ***G03G 15/00*** | (2006.01) |
| ***G03G 21/16*** | (2006.01) |
| ***B41J 11/00*** | (2006.01) |

(52) U.S. Cl.

CPC ..... *B41J 2/17546* (2013.01); *B41J 2/17566* (2013.01); *B41J 2/17596* (2013.01); *B41J 3/543* (2013.01); *B41J 11/007* (2013.01); *B41J 29/02* (2013.01); *B65H 23/04* (2013.01); *G03G 15/6552* (2013.01); *G03G 21/16* (2013.01); *B65H 2402/10* (2013.01); *B65H 2402/60* (2013.01); *B65H 2801/06* (2013.01); *G03G 2215/00021* (2013.01); *G03G 2215/00367* (2013.01)

(56) References Cited

U.S. PATENT DOCUMENTS

| | | | |
|---|---|---|---|
| 2002/0092735 | A1 | 7/2002 | Greive et al. |
| 2004/0069222 | A1 | 4/2004 | Russ |
| 2004/0187772 | A1 | 9/2004 | Russ |
| 2004/0213914 | A1 | 10/2004 | Russ |
| 2005/0195268 | A1 | 9/2005 | Russ |
| 2006/0012102 | A1 | 1/2006 | Bobrow |
| 2006/0034631 | A1 | 2/2006 | Lofthus et al. |
| 2006/0269337 | A1 | 11/2006 | Yasumoto |
| 2007/0071465 | A1 | 3/2007 | Hamby et al. |
| 2008/0024541 | A1 | 1/2008 | Hirato |
| 2008/0112746 | A1 | 5/2008 | Yamamoto |
| 2008/0230985 | A1 | 9/2008 | Bobrow |
| 2008/0279570 | A1 | 11/2008 | Shinohara |
| 2008/0310891 | A1 | 12/2008 | Mochizuki |
| 2009/0060608 | A1 | 3/2009 | Shoji et al. |
| 2009/0237443 | A1 | 9/2009 | Miramanda et al. |
| 2009/0303285 | A1* | 12/2009 | Matsuhashi ..... 347/37 |

FOREIGN PATENT DOCUMENTS

| | | | |
|---|---|---|---|
| EP | 1612051 | A1 | 1/2006 |
| EP | 1626312 | A2 | 2/2006 |
| JP | 7-251511 | | 10/1995 |
| JP | 9-309211 | | 12/1997 |
| JP | 2979393 | | 9/1999 |
| JP | 2979397 | | 9/1999 |
| JP | 2979398 | | 9/1999 |
| JP | 2995465 | | 10/1999 |
| JP | 2000-10370 | | 1/2000 |
| JP | 3026558 | | 1/2000 |
| JP | 2000-141618 | | 5/2000 |
| JP | 2001-38889 | | 2/2001 |
| JP | 2001-58446 | | 3/2001 |
| JP | 2001-80080 | | 3/2001 |
| JP | 2005-111979 | | 4/2005 |
| JP | 2005-161654 | | 6/2005 |
| JP | 2005-199542 | | 7/2005 |
| JP | 2005-250087 | | 9/2005 |
| JP | 2006-69202 | | 3/2006 |
| JP | 2007-1251 | | 1/2007 |
| JP | 2007-301933 | | 11/2007 |
| JP | 2008-9296 | | 1/2008 |
| JP | 2008-119935 | | 5/2008 |
| JP | 2008-126516 | | 6/2008 |
| JP | 2008-221500 | | 9/2008 |

OTHER PUBLICATIONS

Japanese official action dated Dec. 3, 2013 in corresponding Japanese patent application No. 2013-044007.

Japanese official action dated Dec. 4, 2012 in connection with corresponding Japanese patent application No. 2008-281845.

Office Action dated Jan. 16, 2015 in U.S. Appl. No. 12/582,439.

* cited by examiner

IMAGE FORMING APPARATUS AND ASSEMBLY SYSTEM OF IMAGE FORMING APPARATUS

CROSS-REFERENCE TO RELATED APPLICATIONS

This application is Rule 1.53(b) Continuation of application Ser. No. 13/838,149 filed on Mar. 15, 2013 which in turn is a divisional of application Ser. No. 12/582,439, filed Oct. 20, 2009, claiming the priority of Japanese Patent Application No. 2008-281845 filed with the Japanese Patent Office on Oct. 31, 2008.

BACKGROUND OF THE INVENTION

1. Field of the Invention

The present invention relates to an inkjet type image forming apparatus for forming images on a sheet by jetting ink droplets from an inkjet head (hereinafter, also abbreviated as ink head).

2. Description of the Related Art

In recent years, inkjet type image forming apparatuses have been proposed, such as those described in patent documents 1 and 2. Patent document 1 describes an image forming apparatus including plural image forming units connected to each other. Each of the image forming units includes an inkjet engine for jetting ink droplets, which is removably attached to the image forming unit.

Patent document 2 describes an inkjet print system in which plural inkjet print units are disposed at predetermined intervals along a direction of conveying a continuous sheet, so that plural colors can be printed onto both sides of the continuous sheet. The inkjet print system detects marks formed along the continuous sheet, and starts the printing operation performed by the inkjet print units based on detection signals.

FIG. 18 is a schematic diagram of the image forming apparatus described in patent document 1, FIG. 19 is a perspective view of an image forming unit included in the image forming apparatus shown in FIG. 18, and FIG. 20 is a perspective view of an inkjet engine installed in the image forming unit shown in FIG. 19.

The image forming apparatus shown in FIG. 19 includes two image forming units 101A and 101B having substantially the same configuration, which are connected to each other. Each of the image forming units 101A and 101B includes an inkjet engine 102, a sheet feeding cassette 103, a supply conveying path 104 for supplying a recording sheet S in the sheet feeding cassette 103 to the inkjet engine 102, and an eject conveying path 105 for conveying the recording sheet S on which an image has been formed out from the inkjet engine 102.

As shown in FIG. 19, each of the image forming units 101A and 101B have a substantially cubical shape. A conveying inlet 106 for the recording sheet S is formed on one side of the image forming unit 101B, and a conveying outlet (not shown) for the recording sheet S is formed on the other side of the image forming unit 101B.

As shown in FIG. 18, an inkjet engine attachment part 107 is provided between the supply conveying path 104 and the eject conveying path 105. The inkjet engine 102 can be removably attached to the inkjet engine attachment part 107 (see FIG. 19). On one side of the inkjet engine 102, there are provided ink cassettes 108 for separately storing yellow (Y), magenta (M), cyan (C), and black (K) ink. The ink cassettes 108 and the inkjet engine 102 are connected by an ink supplying path 109 (see FIG. 18).

As shown in FIG. 20, the inkjet engine 102 includes a carriage 110, a driving motor 111 for moving the carriage 110 in a main scanning direction, a conveying belt 112 for conveying the recording sheet S, and conveying rollers 113.

The carriage 110 includes ink heads (not shown) each having multiple jetting outlets on the bottom side, for the colors of yellow (Y), magenta (M), cyan (C), and black (K). The conveying belt 112 is rotated/driven by a driving motor 114.

For example, in FIG. 18, the image forming unit 101A is used to print line images, and the image forming unit 101B located on the downstream side of the image forming unit 101A is used to print character images, so that a complete image can be formed. In this manner, the printing operation can be divided between the image forming units 101A and 101B. Therefore, the printing operation can be accelerated and the degree of freedom in forming images can be enhanced.

Patent Document 1: Japanese Laid-Open Patent Application No. 2008-221500

Patent Document 2: Japanese Patent No. 2979393

In the market of inkjet printers, there is increasing demand for high printing speed, highly precise images, and high image quality, and this demand is made for various types (specifications) of printers. In order to manufacture different machine types to address each of the specifications, complex manufacturing operations and increased development costs for the different machine types will be required. In recent years, there is demand for an image forming apparatus in which functions can be easily expanded or changed. Furthermore, with the increase of printing speed, reduction of the machine downtime has been an issue.

In the image forming apparatus illustrated in FIGS. 18 through 20, units such as the inkjet engine 102, the sheet feeding cassette 103, the supply conveying path 104, and the eject conveying path 105 are incorporated into a single body in each of the image forming units 101. Thus, when considering the various specifications of the image forming apparatus as in the present invention described below, none of the units can be shared by other units in this image forming apparatus. For this reason, the functions cannot be easily expanded or changed.

SUMMARY OF THE INVENTION

The present invention provides an image forming apparatus and an assembly system of the image forming apparatus, in which one or more of the above-described disadvantages are eliminated.

A preferred embodiment of the present invention provides an image forming apparatus and an assembly system of the image forming apparatus, in which the functions can be expanded or changed in accordance with the specifications with a high degree of freedom, the machine downtime can be reduced, and development costs and manufacturing costs can be reduced.

According to another aspect of the present invention, there is provided an image forming apparatus including a sheet feed conveying unit having an outlet for a recording medium on one side; plural image forming units each having an inlet for the recording medium on one side and an outlet for the recording medium on the other side; and a sheet eject conveying unit having an inlet for the recording medium on one side, wherein the sheet, feed conveying unit, the plural image forming units, and the sheet eject conveying unit are arranged along a conveying direction of the recording medium; the outlet of the sheet feed conveying unit matches the inlet of one of the plural image forming units located at a most upstream side in the conveying direction of the recording medium; the outlet of one of the plural image forming units located at an upstream side in the conveying direction of the recording medium matches the inlet of one of the plural image forming units located at a downstream side in the conveying direction of the recording medium; the outlet of one of the plural image forming units located at a most downstream side in the conveying direction of the recording medium matches the inlet of the sheet eject conveying unit; and the sheet feed conveying unit, the plural image forming units, and the sheet eject conveying unit are connected to each other in a separable manner.

According to another aspect of the present invention, there is provided an assembly system of an image forming apparatus in which a sheet feed conveying unit, one or more image forming units, and a sheet eject conveying unit are arranged along a conveying direction of a recording medium and connected to each other, wherein a single image forming unit, a twin image forming unit set, and a quadruple image forming unit set are prepared; the single image forming unit includes a first inkjet head filled with ink of a first color, a second inkjet head filled with ink of a second color that is different from the first color, a third inkjet head filled with ink of a third color that is different from the first color or the second color, and a fourth inkjet head filled with ink of a fourth color that is different from the first color, the second color, or the third color; the twin image forming unit set includes a first image forming unit including, a first inkjet head filled with ink of a first color and a second inkjet head filled with ink of a second color that is different from the first color, and a second image forming unit including a third inkjet head filled with ink of a third color that is different from the first color or the second color and a fourth inkjet head filled with ink of a fourth color that is different from the first color, the second color, or the third color; the quadruple image forming unit set includes a first image forming unit including a first inkjet head filled with ink of a first color, a second image forming unit including a second inkjet head filled with ink of a second color that is different from the first color, a third image forming unit including a third inkjet head filled with ink of a third color that is different from the first color and the second color, and a fourth image forming unit including a fourth inkjet head filled with ink of a fourth color that is different from the first color, the second color, or the third color; and in accordance with a specification of the image forming apparatus to be assembled, one of the single image forming unit, the twin image forming unit set, or the quadruple image forming unit set is selected as the one or more image forming units, and the selected one or more image forming units is connected to the sheet feed conveying unit and the sheet eject conveying unit in a separable manner.

According to another aspect of the present invention, there is provided an assembly system of an image forming apparatus, the assembly system including the image forming apparatus including a sheet feed conveying unit, plural types of image forming units each including plural ink heads and color information sensors configured to detect colors of ink filled in the ink heads, and a sheet eject conveying unit, wherein the sheet feed conveying unit, one or plural image forming units selected from the plural types of image forming units, and the sheet eject conveying unit are arranged along a conveying direction of a recording medium and connected to each other in a separable manner; and a higher-level apparatus configured to exchange information with the image forming apparatus, wherein the assembly system sends, to the higher-level apparatus, information indicating a color arrangement of the one or plural image forming units detected by the color information sensors; compares the information indicating the color arrangement with color arrangement reference patterns corresponding to different specifications stored in advance in the higher-level apparatus to determine a specification of the image forming apparatus; and outputs driving control data corresponding to the specification of the image forming apparatus to the sheet feed conveying unit and the sheet eject conveying unit to drive/control the sheet feed conveying unit and the sheet eject conveying unit.

According to one embodiment of the present invention, a tow-cost image forming apparatus and a low-cost assembly system of the image forming apparatus are provided, with which cost increases can be mitigated when developing multiple machine types, the functions can be expanded or changed in accordance with the specifications with a high degree of freedom, and the machine downtime can be reduced.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description in given, with reference to the accompanying drawings, of an inkjet type image forming apparatus and an assembly system of the image forming apparatus according to embodiments of the present invention.

First Embodiment

Figure 1:
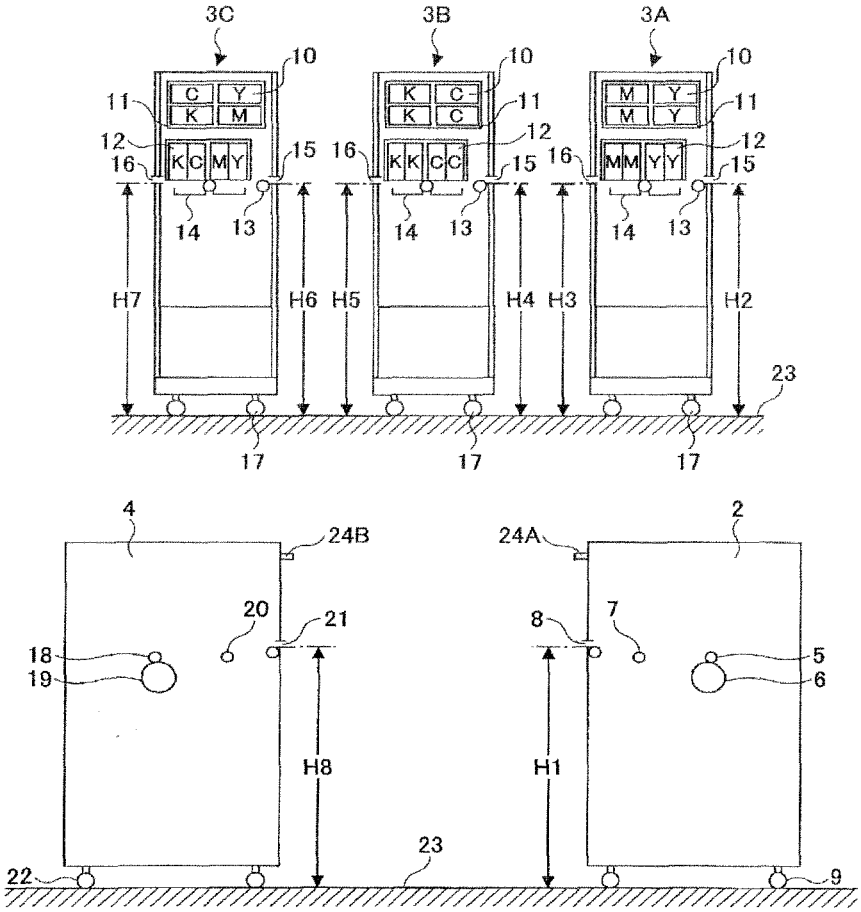
FIG. 1 is a schematic diagram of units of an image forming apparatus according to a first embodiment of the present invention.

FIG. 1 is a schematic diagram of units of an image forming apparatus according to a first embodiment of the present invention.

The image forming apparatus according to the first embodiment is for forming images by an inkjet recording method.

As shown in FIG. 1, the image forming apparatus includes a sheet feed conveying unit 2, plural types of image forming units 3A through 3C, and a sheet eject conveying unit 4. When the image forming apparatus is shipped from the factory or upgraded at the user's site, necessary units are selected from the image forming units 3A through 3C in accordance with the specification, and a combination of the selected units configure the image forming apparatus. The sheet feed conveying unit 2 and the sheet eject conveying unit 4 are commonly used in all of the image forming apparatuses.

Inside the sheet feed conveying unit 2, an in feed roller 5, a nip roller 6, plural guide rollers 7, and a motor (not shown) for driving the in feed roller 5 are provided. A web outlet 8 is formed on one side of the sheet feed conveying unit 2, and casters 9 with stoppers are provided on the bottom side of the sheet feed conveying unit 2. The sheet feed conveying unit 2 includes various function units such as a web meander correction mechanism, a web discharging mechanism, and a web cleaning mechanism, but these units are not shown as they are not directly related to the present invention.

In the present embodiment, two types of image forming units 3 are provided; the image forming units 3A and 3B correspond to the first type and the image forming unit 3C corresponds to the second type. The two types of image forming units have the same structure. That is, inside each of the image forming units 3A through 3C, a cassette attachment part 11 for attaching four ink cassettes 10 at the top of each unit, four ink heads 12 installed at the bottom of the cassette attachment part 11, plural platen rollers 13 for conveying/guiding a web 1 depicted in FIG. 2 so that the web 1 passes under the ink heads 12, an ink receiver 14 for receiving ink used for test-jetting, and an ink supplying path (not shown) for supplying ink inside the ink cassettes 10 to the ink heads 12 are provided.

A web inlet 15 is formed on one side of the image forming unit 3, a web outlet 16 is formed on the opposite side of the image forming unit 3, and casters 17 with stoppers are provided on the bottom side of the image forming unit 3.

The image forming units 3A and 3B are used together as a set. In the image forming unit 3A, two of each of the ink cassettes 10 storing yellow (Y) ink and the ink cassettes 10 storing magenta (M) ink are arranged, and two of each of the ink heads 12 for yellow (Y) ink and the ink heads 12 for magenta (M) ink are arranged. In the image forming unit 3B, two of each of the ink cassettes. 10 storing cyan (C) ink and the ink cassettes 10 storing black (K) ink are arranged, and two of each of the ink heads 12 for cyan (C) ink and the ink heads 12 for black (K) ink are arranged.

Meanwhile, in the image forming unit 3C, one of each of the ink cassette 10 storing yellow (Y) the ink cassette 10 storing magenta (M) ink, the ink cassette 10 storing cyan ink, and the ink cassette 10 storing black (K) ink are arranged, and one of each of the ink head 12 for yellow (Y) ink, the ink head 12 for magenta (M) ink, the ink head 12 for cyan (C) ink, and the ink head 12 for black (K) ink are arranged.

Inside the sheet eject conveying unit 4, an out feed roller 18, a nip roller 19, plural guide rollers 20, and a motor (not shown) for driving the out feed roller 18 are provided.

A web inlet 21 is formed on one side of the sheet eject conveying unit 4, and casters 22 with stoppers are provided on the bottom side of the sheet eject conveying unit 4. The sheet eject conveying unit 4 also includes units such as a drying unit for drying the ink; however, these units are not directly related to the present invention, and thus are not shown.

A height H1 from a floor 23 to the web outlet 8 of the sheet feed conveying unit 2, and a height H2 of the web inlet 15 of the image forming unit 3A adjacent to the sheet feed conveying unit 2, are substantially equal (H1≈H2). A height H3 of the web outlet 15 of the image forming unit 3A, and a height H4 of the web inlet 15 of the image forming unit 3B, are substantially equal (H3≈H4). A height H5 of the web outlet 16 of the image forming unit 33, and a height H8 of the web inlet 21 of the sheet elect conveying unit 4, are substantially equal (H5≈H8). The height H1 of the web outlet 8 of the sheet feed conveying unit 2, and a height H6 of the web inlet 15 of the image forming unit 30, are substantially equal (H1≈H6). A height H7 of the web outlet 16 of the image forming unit 3C, and the height H8 of the web inlet 21 of the sheet eject conveying unit 4, are substantially equal (H7≈H8). All of the heights H1 through H8 may be substantially equal (H1≈H2≈H3≈H4≈H5≈H6≈H7≈H8).

In order to configure an image forming apparatus having a one-line configuration, the sheet feed conveying unit 2 and the sheet eject conveying unit 4 are combined, with the image forming units 3 disposed therebetween. The following parts are provided for the purpose of determining the positions of units when combining them together. Specifically, protrusion parts 24A and 24B are respectively formed on the sides of the sheet feed conveying unit 2 and the sheet eject conveying unit 4 that are joined with the image forming units 3. Recess parts or holes (not shown) for fitting in the protrusion parts 24A and 24B are respectively formed on the sides of the image forming units 3 that are joined with the sheet feed conveying unit 2 and the sheet eject conveying unit 4. Conversely, protrusion parts may be formed on the sides of the image forming units 3, and recess parts or holes may be formed on the sheet feed conveying unit 2 and the sheet eject conveying unit 4.

Figure 2:
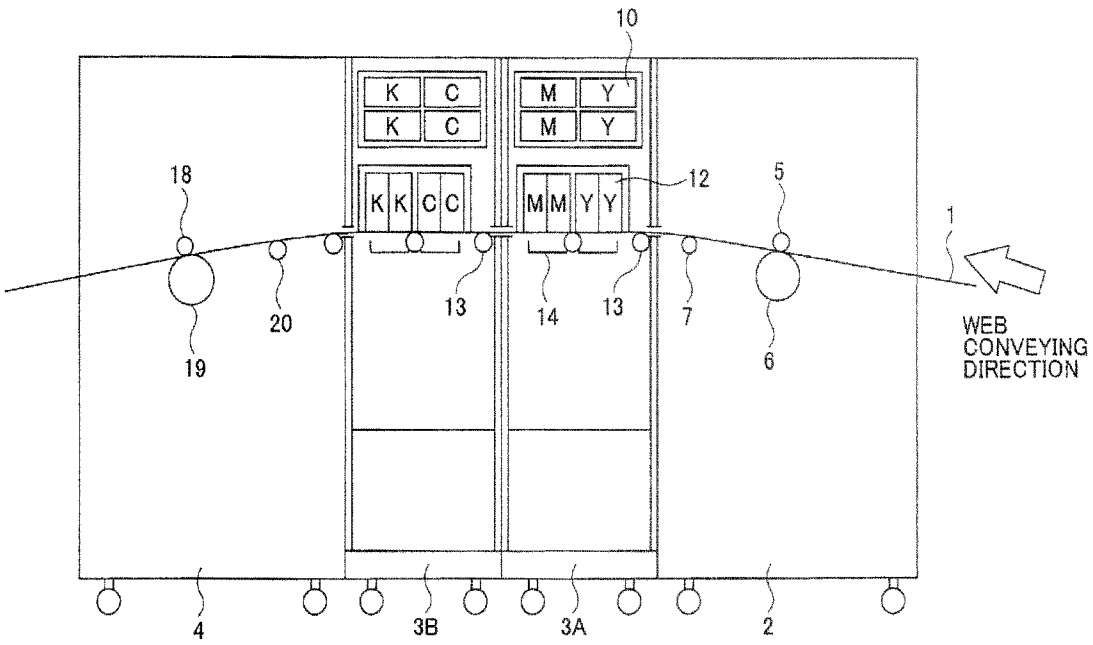
FIG. 2 is a schematic diagram of an image forming apparatus according to a first specification.

FIG. 2 is a schematic diagram of an image forming apparatus according to a first specification. In an image forming apparatus 201 according to this specification, a unit assembly of the image forming units 3A and 3B is disposed between the sheet feed conveying unit 2 and the sheet eject conveying unit 4. As shown in FIG. 2, the sheet feed conveying unit 2, the image forming unit 3A, the image forming unit 3B, and the sheet eject conveying unit 4 are arranged in this order along a conveying direction (indicated by an arrow) of the web 1. The relative positions of the units are determined, and the units are connected to each other with bolts and nuts (in a separable manner), so that adjacent web outlets and web inlets match each other.

The web 1 is a long, continuous sheet that is in a form of a roll. The web 1 is conveyed from the sheet feed conveying unit 2 to the image forming units 3A and 3B at a high speed of, for example, 150 m/min., by the collaboration of the in feed roller 5 and the nip roller 6 of the sheet feed conveying unit 2. The ink color arrangement in the image forming unit 3A is Y-Y-M-M along the conveying direction of the web 1, and the ink color arrangement in the image forming unit 3B is C-C-K-K along the conveying direction of the web 1. That is, in each of the image forming units 3A and 3B, two ink heads 12 are provided for each of two colors. Furthermore, inside each of the image forming units 3A and 3B, a mechanism for supplying the ink from each ink cassette 10 to the corresponding ink head 12, and ink paths are provided.

Figure 3:
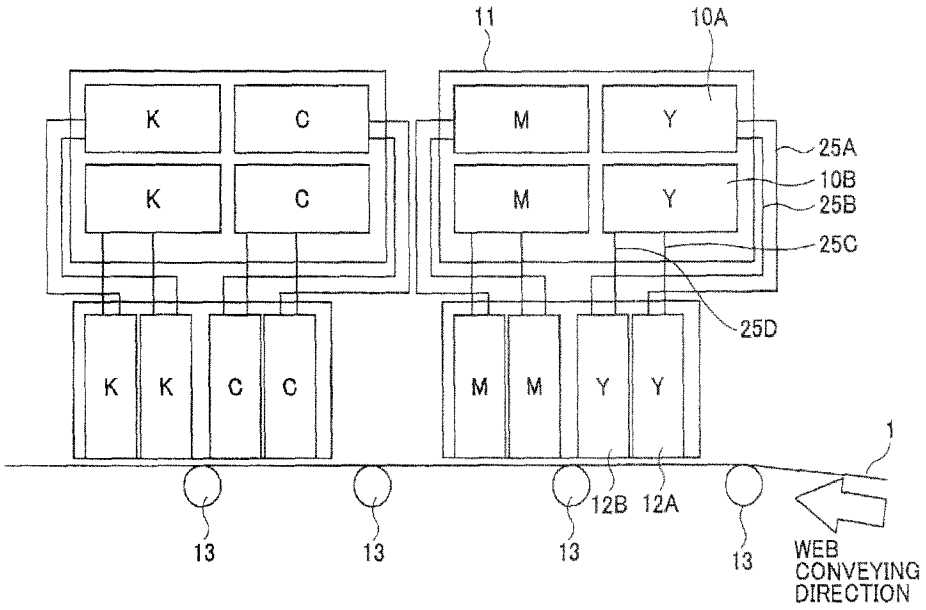
FIG. 3 illustrates a connection relationship between ink cassettes and ink heads in the image forming apparatus shown in FIG. 2.

FIG. 3 illustrates the connection relationship between the ink cassettes 10 and the ink heads 12 in the image forming apparatus 201. In the image forming apparatus 201, the ink color arrangement of the ink heads 12 is Y-Y-M-M, C-C-K-K along the conveying direction of the web 1, and similarly, the ink color arrangement of the ink cassettes 10 is Y-Y-M-M, C-C-K-K. Accordingly, two of the ink cassettes 10 and two of the ink heads 12 of the same color are disposed close to each other.

As shown in FIG. 3, two ink supplying paths 25A and 25B extend from a first Y ink cassette 10A, and connect with a first Y ink head 12A and a second Y ink head 12B. Two ink supplying paths 25C and 250 extend from a second Y ink cassette 10B, and connect with the first Y ink head 12A and the second Y ink head 12B.

With such a configuration, the ink cassettes 10A and 10B can be shared by the first Y ink head 12A and the second Y ink head 12B, and therefore even when the ink cassette 10A becomes empty, ink can be supplied from the other ink cassette 10B, so that the printing operation can be continued. Accordingly, the machine downtime can be reduced.

The connections between the ink cassettes 10 and the ink heads 12 for M, C, and K are the same as that of Y as shown in FIG. 3, and are thus not further described. In FIG. 3, valves are provided in the ink supplying paths and level sensors and empty sensors are provided in the ink cassettes 10 for detecting the remaining amount of ink; however, these elements are not shown as a matter of simplification.

The web 1 on which a color image has been formed by the image forming units 3A and 3B, is ejected from the sheet eject conveying unit 4 by the collaboration of the out feed roller 18 and the nip roller 19. Then, the web 1 may be rolled, folded, or cut into sheets according to the final product. While the web 1 is being conveyed from the sheet feed conveying unit 2 to the sheet eject conveying unit 4, predetermined tension is applied to the web 1 by a tension applying unit (not shown) for preventing the web 1 from flapping.

When the web 1 is being conveyed along the path extending from the sheet feed conveying unit 2 to the sheet eject conveying unit 4 through the image forming units 3, predetermined tension is applied to the web 1, and the web 1 is guided so as to pass through the image forming units 3 at a higher position than the position at which the web 1 passes through the sheet feed conveying unit 2 and the sheet eject conveying unit 4. Accordingly, the web 1 certainly comes in contact with the platen rollers 13. The positions of the platen rollers 13 can be adjusted in the vertical direction perpendicular to the conveying direction of the web 1. Therefore, in accordance with the number of connected image forming units 3 and the extent of the tension, the positions of the platen rollers 13 are adjusted in the vertical direction so that the web 1 certainly comes in contact with the platen rollers 13. The platen rollers 13 are adjusted in the vertical direction by, for example, screws and springs. The image forming apparatuses described below also have the same configuration as that described above.

The web 1 having tension applied thereto certainly comes in contact with the platen rollers 13, and therefore the web 1 is prevented from flapping and the precision of the gap between the ink heads 12 and the web 1 is improved (maintained). Accordingly, the ink lands at highly precise positions so that high-quality images can be formed.

Figure 4:
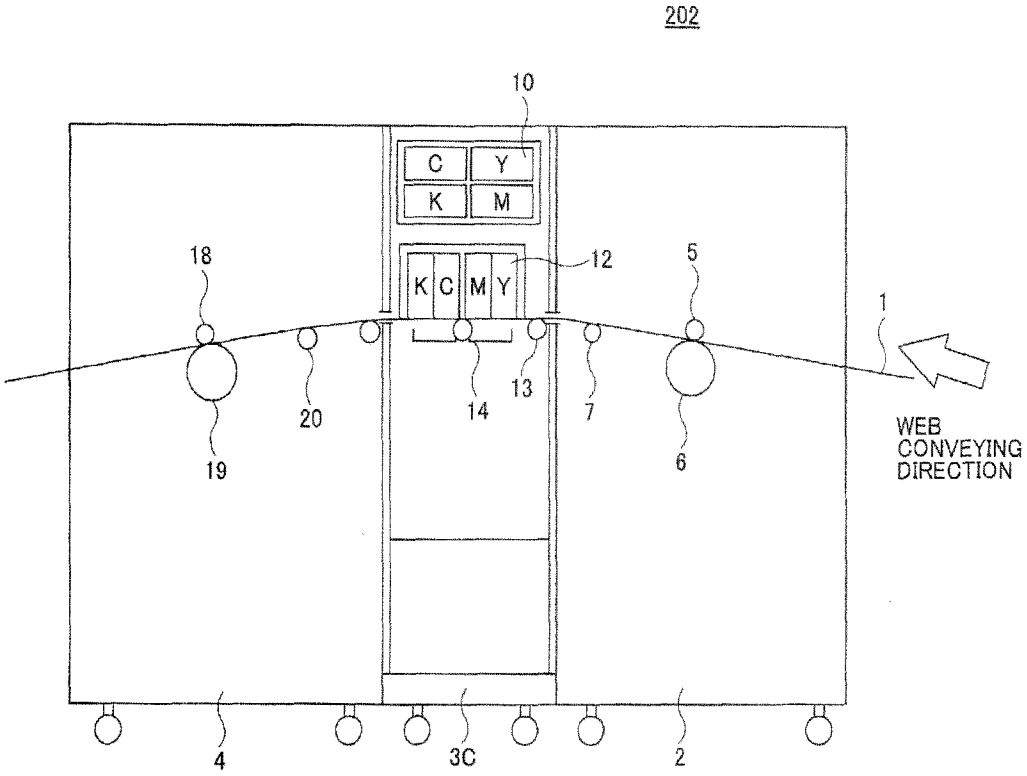
FIG. 4 is a schematic diagram of an image forming apparatus according to a second specification.

FIG. 4 is a schematic diagram of an image forming apparatus according to a second specification. In an image forming apparatus 202 according to this specification, one image forming unit 3C is disposed between the sheet feed conveying unit 2 and the sheet eject conveying unit 4. As shown in FIG. 4, the sheet feed conveying unit 2, the image forming unit 3C, and the sheet eject conveying unit 4 are arranged in this order along the conveying direction of the web 1. The relative positions of the units are determined, and the units are connected to each other with bolts and nuts (in a separable manner), so that adjacent web outlets and web inlets match each other.

The ink color arrangement of the ink heads 12 is Y-M-C-K along the conveying direction of the web 1, and similarly, the ink color arrangement of the ink cassettes 10 is Y-M-C-K. Accordingly, the Ink cassettes 10 and the ink heads 12 of the same color are disposed close to each other.

Figure 5:
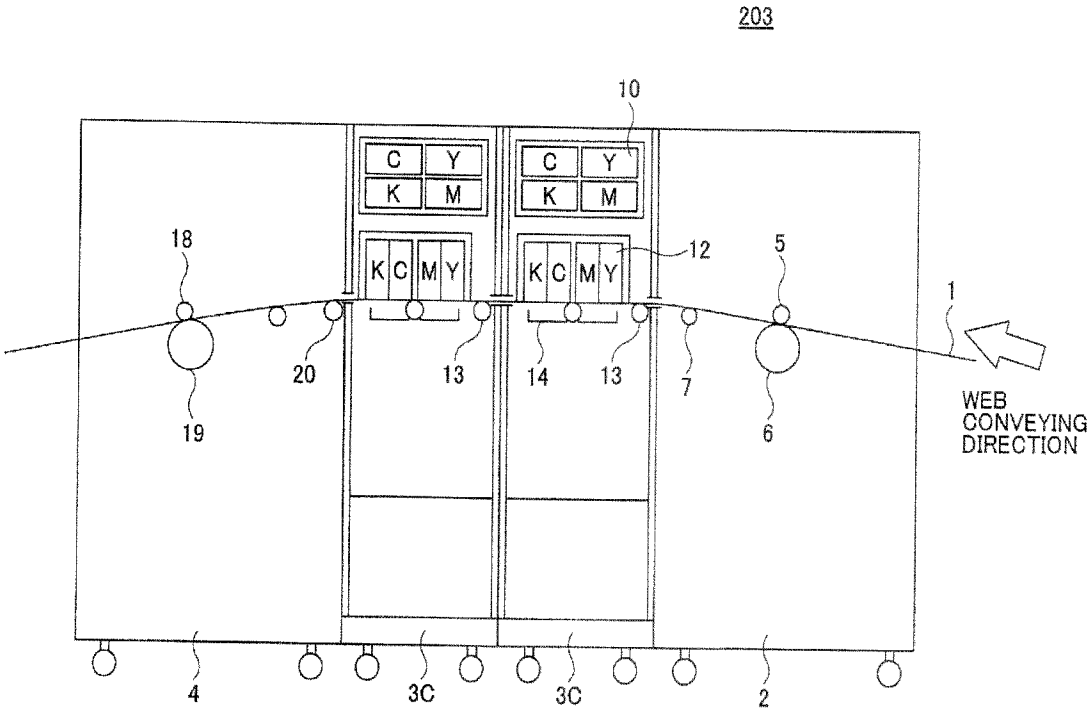
FIG. 5 is a schematic diagram of an image forming apparatus according to a third specification.

FIG. 5 is a schematic diagram of an image forming apparatus according to a third specification. In an image forming apparatus 203 according to this specification, two image forming units 30 are disposed between the sheet feed conveying unit 2 and the sheet eject conveying unit 4. As shown in FIG. 5, the sheet feed conveying unit 2, the first image forming unit 3C, the second image forming unit 30, and the sheet eject conveying unit 4 are arranged in this order along the conveying direction of the web 1. The relative positions of the units are determined, and the units are connected to each other with bolts and nuts (in a separable manner), so that adjacent web outlets and web inlets match each other.

When the two image forming units 3C and 3C have the same color arrangement, i.e., Y-M-C-K and Y-M-C-K as shown in FIG. 5, and an ink cassette 10 of a certain color is to be shared by two ink heads 12, one of the ink paths may need to be extended or cross-over to the other image forming unit 3C, and therefore the ink paths may be connected in a complex manner. This disadvantage can be overcome by applying the specification as illustrated in FIGS. 2 and 3.

In each of the image forming apparatuses illustrated in FIGS. 1 through 5, a roll attaching unit for attaching a roll of the web 1 before image formation is provided separately from the sheet feed conveying unit 2. However, the roll attaching unit may be provided in the sheet feed conveying unit 2. Furthermore, in the above-described image forming apparatuses, a post-process mechanism for performing a post-process on the web 1 after image formation, is provided separately from the sheet eject conveying unit 4. However, the post-process mechanism may be provided in the sheet eject conveying unit 4.

Second Embodiment

Figure 6:
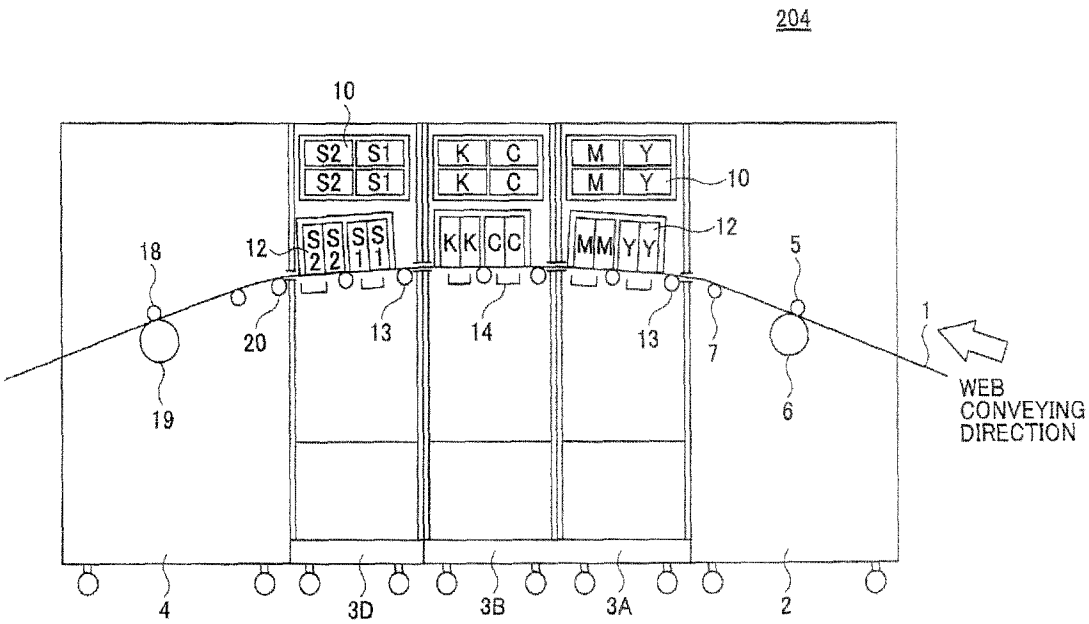
FIG. 6 is a schematic diagram of units of an image forming apparatus according to a second embodiment of the present invention.

FIG. 6 is a schematic diagram of units of an image forming apparatus according to a second embodiment of the present invention. In an image forming apparatus 204 according to the present embodiment, in between the sheet feed conveying unit 2 and the sheet eject conveying unit 4, an image forming unit 3D corresponding to special colors used by the user is disposed in addition to the image forming units 3A and 3D. In the present embodiment, the image forming unit 3D of the special colors is disposed on the downstream side of the image forming units 3A and 3B in the web conveying direction. By using such an image forming unit 3D of special colors, a diverse range of colors can be used, thereby forming images of higher quality.

When an increased number of image forming units 3 are disposed between the sheet feed conveying unit 2 and the sheet eject conveying unit 4, the web 1 may not contact the platen rollers 13 or may not stably contact the platen rollers 13 in one of the image forming units 3. In order to overcome this disadvantage, in the present and subsequent embodiments, the vertical positions of the platen rollers 13 in each of the image forming units 3 are adjusted so that the trajectory of the web 1 conveyed through the image forming units 3 forms a circular arc with the middle portion protruding upward, as shown in FIG. 6.

Third Embodiment

Figure 7:
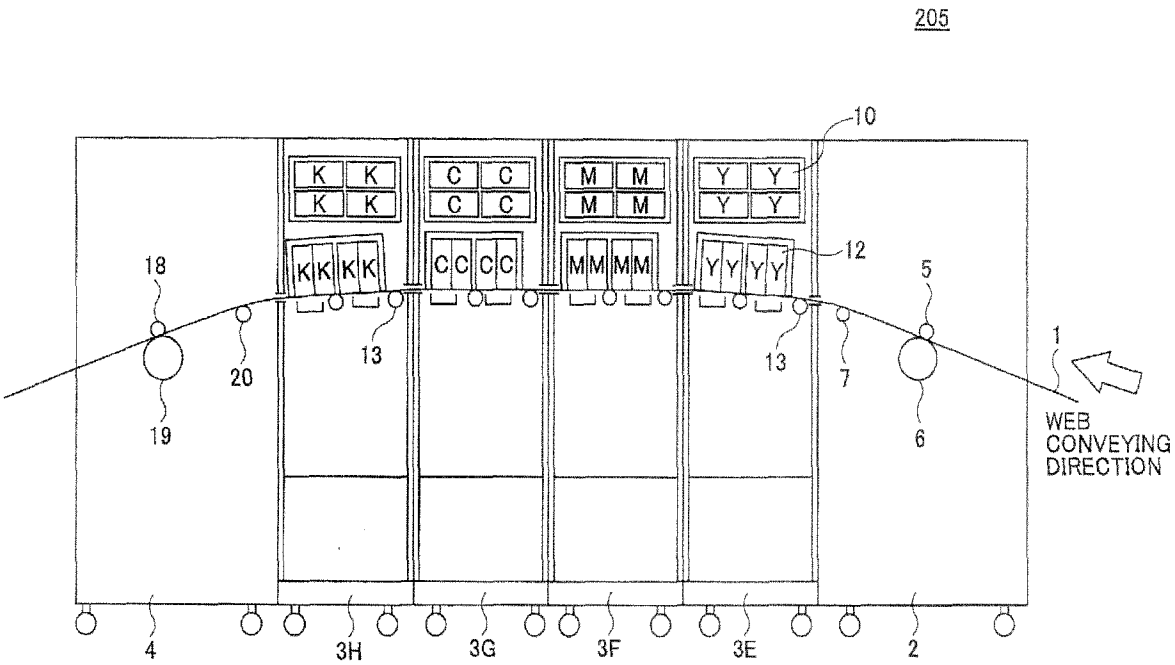
FIG. 7 is a schematic diagram of units of an image forming apparatus according to a third embodiment of the present invention.

FIG. 7 is a schematic diagram of units in an image forming apparatus according to a third embodiment of the present invention. In an image forming apparatus 205 according to the present embodiment, four image forming units 3E through 3H are disposed between the sheet feed conveying unit 2 and the sheet eject conveying unit 4.

The ink color arrangement of the ink heads 12 in the image forming unit 3E is Y-Y-Y-Y, the ink color arrangement of the ink heads 12 in the image forming unit 3F is M-M-M-M, the ink color arrangement of the ink heads 12 in the image forming unit 3G is C-C-C-C, and the ink color arrangement of the ink heads 12 in the image forming unit 3H is K-K-K-K, i.e., four ink heads 12 are provided for each color. The printing speed of the image forming apparatus 205 according to the present embodiment is set at approximately 210 m/min.

Although not shown, in the image forming apparatus 205 according to the present embodiment, an ink cassette 10 of a certain color is shared by two ink heads 12, and the ink supplying paths between the ink cassettes 10 and the ink heads 12 are substantially the same as those shown in FIG. 3.

With respect to the image forming apparatus 202 shown in FIG. 4, the image forming apparatus 201 shown in FIG. 2 has two times as many ink heads 12 of the same color, and the image forming apparatus 205 shown in FIG. 7 has four times as many ink heads 12 of the same color. Therefore, assuming that the printing resolution in the web conveying direction is the same, theoretically, the printing speed of the image forming apparatus 201 is two times as fast as that of the image forming apparatus 202, and the printing speed of the image forming apparatus 205 is four times as fast as that of the image forming apparatus 202.

Accordingly, for a user that does not require such a high printing speed (for example, when the desired speed is approximately 70 m/min.), the image forming apparatus 202 shown in FIG. 4 may be provided, so that the cost and space used can be reduced. Meanwhile, for a user that desires a high printing speed (for example, when the desired speed is approximately 150 m/min. or 210 m/min.), the image forming apparatus 201 shown in FIG. 2, the image forming apparatus 203 shown in FIG. 5, or the image forming apparatus 205 shown in FIG. 7 may be provided according to the desired specifications.

Furthermore, when the user using the image forming apparatus 202 desires a higher printing speed, additional image forming units 3 may be selected and connected, while using the same sheet feed conveying unit 2 and sheet eject conveying unit 4. Accordingly, the image forming apparatus 202 can be upgraded to any of the image forming apparatuses 201, 203, and 205. In this case, there is no need for replacing the entire apparatus. Therefore, costs can be reduced, the time required for installment can be reduced, the machine downtime can be reduced, and the degree of freedom can be enhanced in expanding and changing the functions in accordance with the specifications.

As shown in FIGS. 2, 4, and 7, the same ink color arrangement information (order of printing colors) is used when one image forming unit 3 is provided and when plural image forming units 3 are provided (in the above embodiment, the order is Y, M, C, and K). Accordingly, the appropriate printing color order can be maintained in consideration of image quality, and a common color imaging process can be performed when one image forming unit 3 is provided and when plural image forming units 3 are provided.

Figure 8:
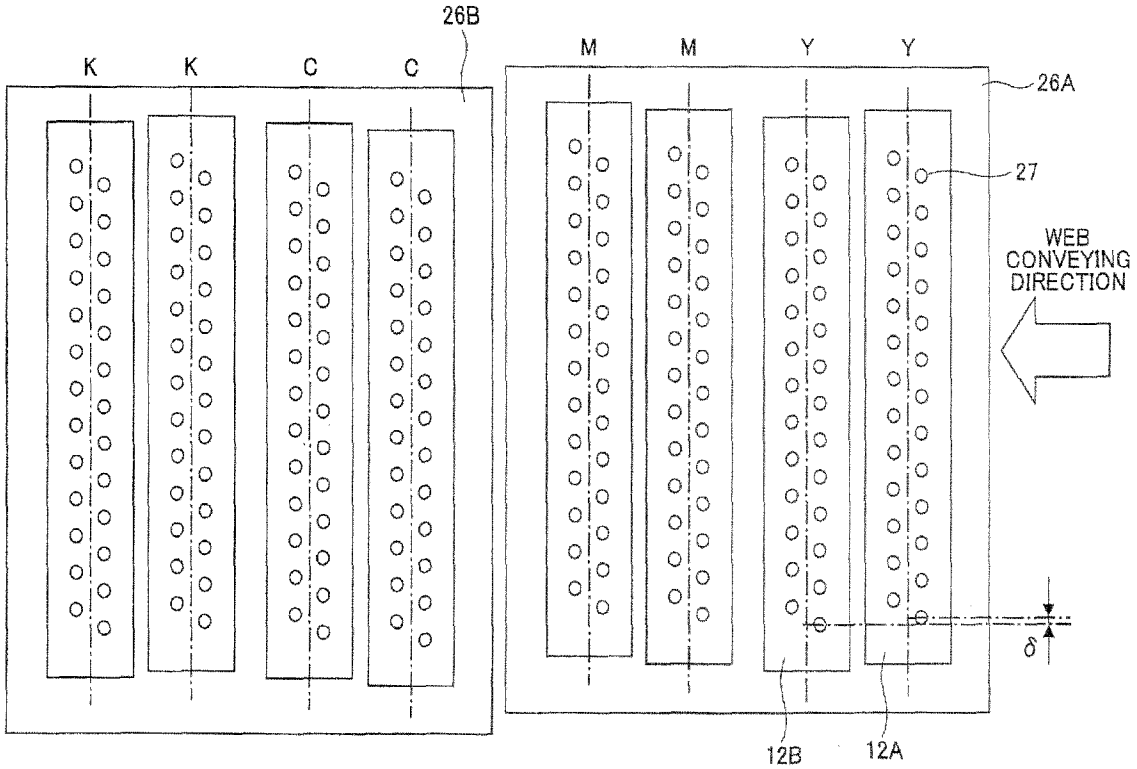
FIG. 8 is a schematic diagram illustrating nozzle surfaces of ink heads used in the image forming apparatus shown in FIG. 2.

Next, the precision of relative positions of the ink heads 12 of the same color is described with reference to FIGS. 8 and 9. FIG. 8 is a schematic diagram illustrating the nozzle surfaces of the ink heads 12 used in the image forming apparatus 201 shown in FIG. 2. As shown in FIG. 8, the first Y ink head 12A and the second Y ink head 12B are fixed adjacent to each other in parallel, on a single base 26A. In each ink head 12, multiple nozzles 27 are arranged along a width direction (main scanning direction that is perpendicular to the conveying direction of the web 1, thereby configuring a line head.

The position of each ink head 12 with respect to the base 26 may determined by fitting together surfaces that have been worked for the purpose of positioning, or fitting positioning pins into positioning holes (not shown). In the case of FIG. 8, the ink heads 12 of the same color are juxtaposed and fixed on the same base 26A, and therefore relative positional errors between the nozzles 27 of the first Y ink head 12A and the second Y ink head 12B can be prevented. As a result, the positional errors δ between the nozzles 27 in the main scanning direction (width direction of web 1) are reduced. The same applies to the relationships between the other ink heads 12.

Figure 9:
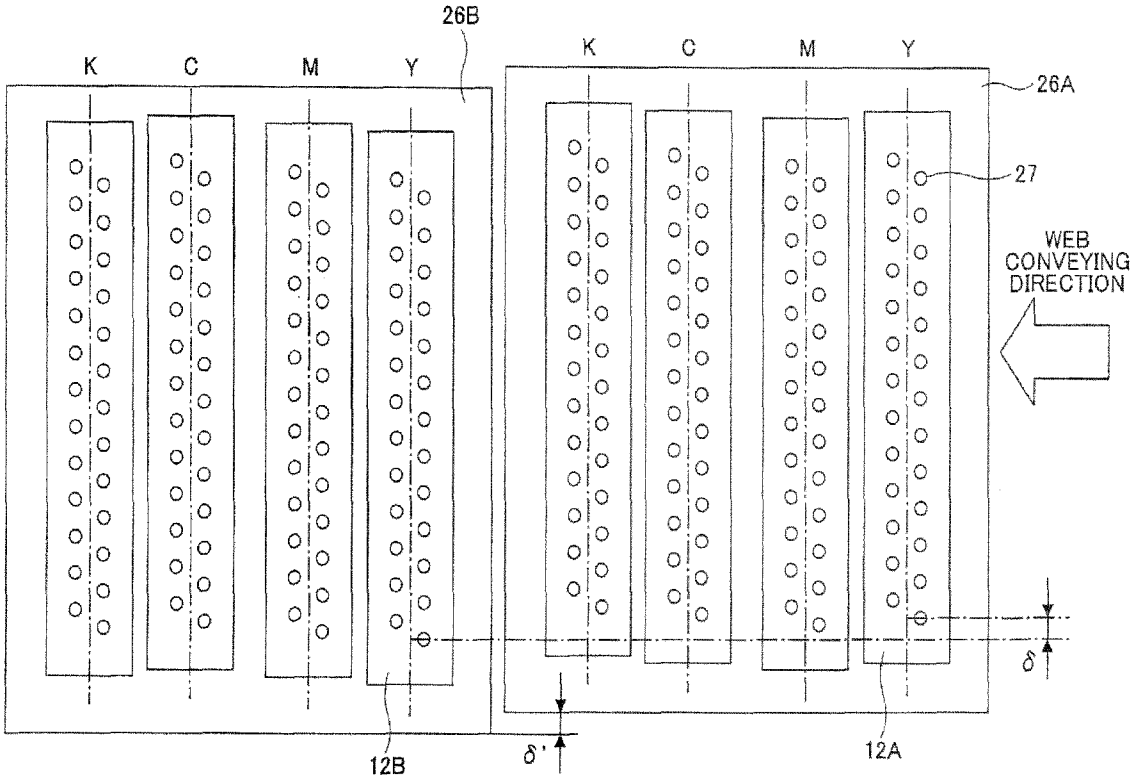
FIG. 9 is a schematic diagram illustrating nozzle surfaces of ink heads used in the image forming apparatus shown in FIG. 4.

FIG. 9 is a schematic diagram illustrating the nozzle surfaces of the ink heads 12 used in the image forming apparatus 202 shown in FIG. 4. As shown in FIG. 9, the first Y ink head 12A is fixed on one base 26A, while the second Y ink head 12B is fixed on the other base 26B. Therefore, the positional error δ' between the base 26A and the base 26B is added, consequently increasing the positional errors δ between the nozzles 27 in the main scanning direction. The same applies to the relationships between the other ink heads 12.

When the temperature in the apparatus increases due to continuous printing, the larger the interval between the ink heads 12A and 12B, the larger the differences in temperature and in thermal expansion between the ink heads 12A and 12B. As a result, the positional errors δ in the main scanning direction are apt to increase.

In FIG. 8, the positional errors in the main scanning direction between the nozzles 27 of the ink heads 12 of the same color are small, and therefore compensatory effects can be expected. For example, among two nozzles 27 on the same line in the main scanning direction, one of the nozzles 27 may become unable to strike a pixel while the other nozzle 27 strikes a corresponding pixel. In this case, nozzles 27 of different ink heads 12 will be used to strike adjacent pixels, but the pitch error between these pixels can be mitigated.

Furthermore, two different nozzles 27 can be used to strike liquid droplets at the same pixel position, so that multi-valued liquid droplets can be provided. For example, assuming that each of the nozzles can strike liquid droplets of two different sizes (large and small), and two different nozzles 27 are used to strike the same pixel, the sizes of the liquid droplets jetted from the nozzles 27 can be controlled (for example, large-large, large-small (small-large), and small-small). Accordingly, the sizes of the pixels can be optionally controlled.

The above description is given for the main scanning direction; the same applies to the sub scanning direction. Accordingly, with the ink color arrangement of FIG. 8, higher precision can be achieved and images of higher quality can be recorded, compared to that of FIG. 9.

In the above examples, each ink head 12 corresponds to one color, and different ink color arrangements may be provided by switching the positions of the ink heads 12. In another example, there may be ink heads each including plural nozzle rows (for example, four rows) and image forming units having separate ink supplying paths for each of the nozzle rows. In this case, the ink color arrangement can be changed in units of nozzle tree in each ink head to achieve the same effects as the above examples.

Fourth Embodiment

Figure 10:
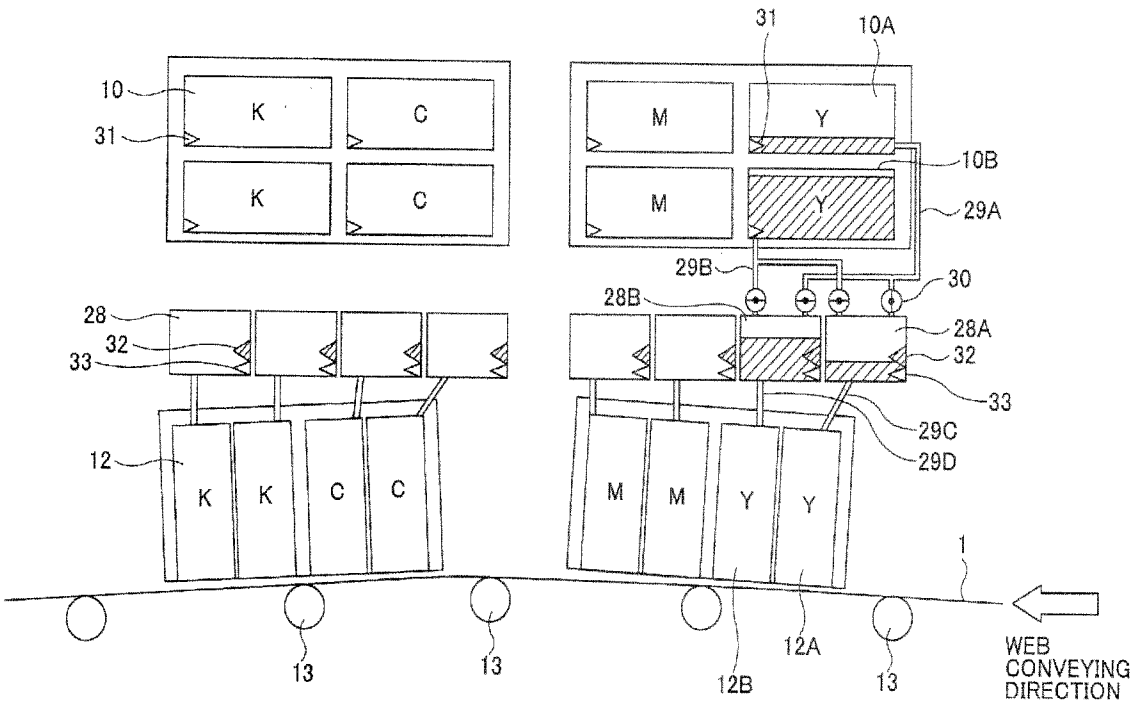
FIG. 10 illustrates a connection relationship between ink cassettes and ink heads of an image forming apparatus according to a fourth embodiment of the present invention.

FIG. 10 illustrates a modification (fourth embodiment) of the connection relationship between the ink cassettes 10 and the ink heads 12 shown in FIG. 3.

This modification is described by taking as an example the ink supplying path for yellow (Y). First and second Y sub ink cassettes 28A and 28B are disposed between the first and second Y ink cassettes 10A and 10B and the first and second 3 ink heads 12A and 12B.

A first ink supplying path 29A extends from the first Y ink cassette 10A and branches midway to connect to the first and second Y sub ink cassettes 28A and 28B which then connects to the first and second Y ink heads 12A and 12B. Valves 30 are provided on the branched supplying paths. Similarly, a second ink supplying path 290 extends from the first Y ink cassette 10A and branches midway to connect to the first and second Y sub ink cassettes 28A and 28B which then connects to the first and second Y ink heads 12A and 12B. The valves 30 are provided on the branched supplying paths.

Furthermore, a third ink supplying path 290 extends from the first Y sub ink cassette 28A to the first Y ink head 12A, and a fourth ink supplying path 290 extends from the second Y sub ink cassette 28B to the second Y ink head 12B.

Ink cassette empty sensors 31 are provided in the Y ink cassettes 10A and 10B. Sub ink cassette level sensors 32 (for detecting remaining amount) and sub ink cassette empty sensors 33 are provided in the Y sub ink cassettes 28A and 28B.

For example, when the sub ink cassette level sensor 32 detects that the remaining amount of ink is small as shown in the first Y sub ink cassette 28A, the corresponding valve 30 is opened so that ink can be supplied from the Y ink cassette 10A. FIG. 10 illustrates a state where ink is supplied to the first Y sub ink cassette 28A. Accordingly, the valve 30 on the far right is open, while the other valves 30 are closed.

Furthermore, when the ink cassette empty sensor 31 detects that the ink cassette is empty as shown is the first Y ink cassette 10A, the ink cassette to be used is switched to another ink cassette of the same color (in this case, the second Y ink cassette 10B). With regard to the empty ink cassette (in this case, the first Y ink cassette 10A), an empty alarm is displayed on an operations panel (not shown) of the image forming apparatus. The operator replaces the first Y ink cassette 10A with a new one in response to this alarm.

Each ink cassette is continuously used until it becomes empty. That is, the ink cassettes of the same color are sequentially used until each are finished. For example, even after the empty state of an ink cassette (first Y ink cassette 10A) has been cancelled by replacing it with a new one, the new one will not be used unless the ink cassette that is presently used for supplying ink (second Y ink cassette 10B) becomes empty.

By sequentially switching the ink cassette to be used for supplying ink, it is possible to prevent plural (all of the) ink cassettes from becoming empty at the same time. Therefore, it is possible to minimize situations where the printing operation stops because of empty ink cassettes. Accordingly, the machine downtime can be reduced.

Even when all of the ink cassette empty sensors 31 of the same color detect ink cassette empty states, as long as there is ink of the same color in the sub ink cassette 28, compensatory printing can be performed by decreasing the printing speed.

When all of the ink cassette empty sensors 31 and all of the sub ink cassette empty sensors 33 of the same color detect ink cassette empty states, an ink empty error (stop printing) is displayed on the operations panel of the image forming apparatus, and the printing operation of the image forming apparatus is automatically stopped.

Fifth Embodiment

Figure 11:
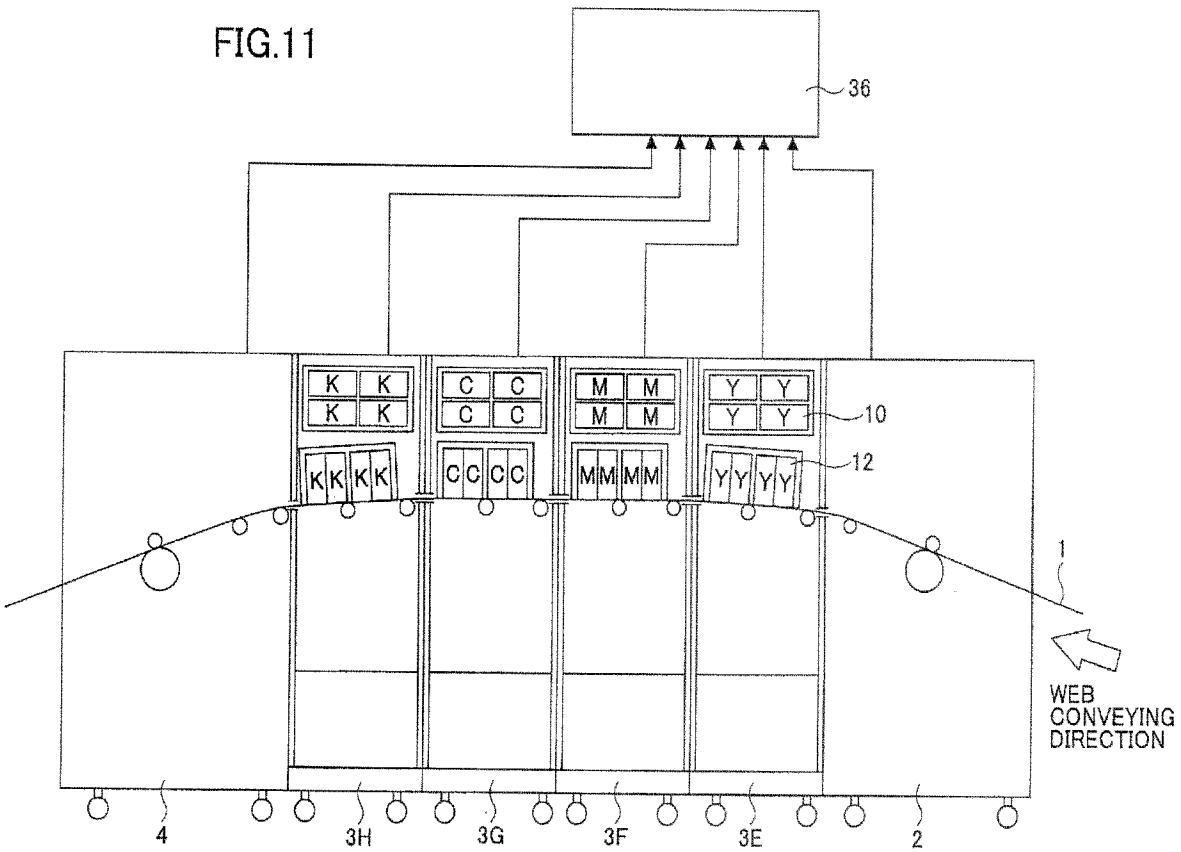
FIG. 11 is a schematic diagram of an image forming apparatus according to a fifth embodiment of the present invention.
Figure 12:
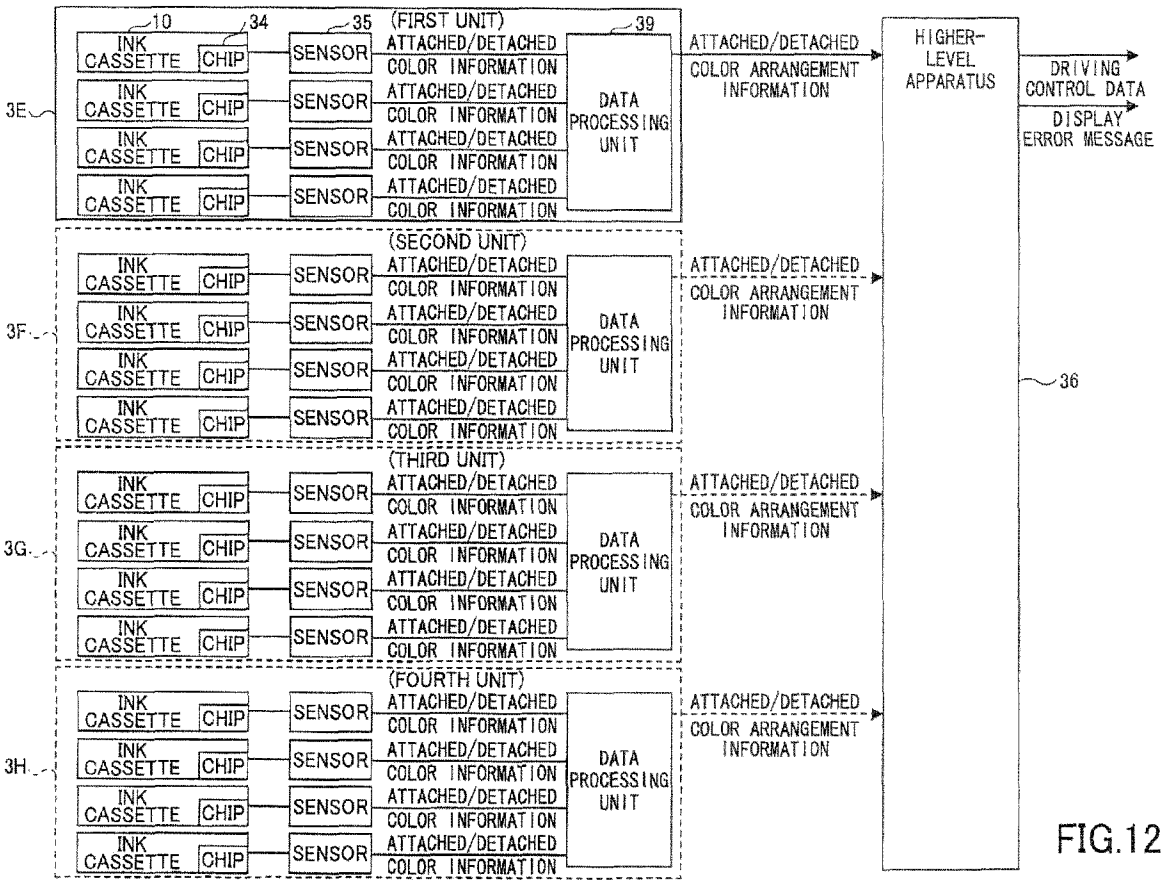
FIG. 12 is a block diagram indicating a relationship between image forming units of the image forming apparatus shown in FIG. 11 and a higher-level device.

FIG. 11 is a schematic diagram of an image forming apparatus according to a fifth embodiment of the present invention. FIG. 12 is a block diagram indicating the relationships between the image forming units and a higher-level device.

As shown in FIG. 12, each of the ink cassettes 10 includes a chip 34 recording color information of the ink stored in the corresponding cassette. Furthermore, a color information detecting sensor 35 is set in advance at a position that is near/faces the chip 34 when the ink cassette 10 is attached to the cassette attachment part 11 of the image forming apparatus.

The means for detecting color information is not limited to a chip. Various methods are applicable, such as a method of detecting the color of the ink or the color of the label of the ink cassette, and a method of forming the ink cassettes so as to have different shapes according to the colors and detecting the differences in the shapes with a photo sensor or a micro switch.

In the present embodiment, four ink cassettes 10 storing yellow (Y) ink can be attached in the first image forming unit 3E, four ink cassettes 10 storing magenta (M) ink can be attached in the second image forming unit 3F, four ink cassettes 10 storing cyan (C) ink can be attached in the third image forming unit 30, and four ink cassettes 10 storing black (K) ink can be attached in the fourth image forming unit 3H.

Each color information detecting sensor 35 detects whether the ink cassette 10 has been attached/detached, and detects the color information of the chip 34. It can be determined whether the ink cassette 10 has been attached/detached according to a detection signal from the color information detecting sensor 35. In the present embodiment, the color information detecting sensor 35 also serves as a detection sensor for detecting whether the ink cassette 10 has been attached/detached. However, another sensor can be provided for detecting whether the ink cassette 10 has been attached/detached. The number of components and costs can be reduced by having the color information detecting sensor 35 serve as both a color sensor and a sensor for detecting whether the ink cassette 10 has been attached/detached, as described in the present embodiment.

Information from the color information detecting sensor 35 is first stored in a data processing unit 39 provided in each image forming unit 3. Based on the stored color information, ink color arrangement information for the corresponding image forming unit 3 is created. For example, when four ink cassettes 10 storing yellow (Y) ink are normally attached in the first image forming unit 3E, the ink color arrangement information is Y-Y-Y-Y; however, when an ink cassette 10 storing ink of a different color is erroneously attached, the ink color arrangement information will be, for example, Y-M-Y-Y. Information indicating whether the ink cassette 10 has been attached/detached and ink color arrangement information is sent from the data processing unit 39 to a higher-level apparatus 36, starting from the first image forming unit 3E.

In the higher-level apparatus 36, based on the ink color arrangement information and the printing data, separate driving control data items are created for the each of the image forming units 3 and the created driving control data items are sent to each of the image forming units 3. In each of the image forming units 3, the ink heads 12 are driven based on the corresponding driving control data item to jet ink droplets onto a conveyed web 1, thereby forming a color image with the ink droplets that have landed on the conveyed web 1.

When the ink color arrangement information received by the higher-level apparatus 36 is Y-M-C-K, the higher-level apparatus 36 determines that the ink color arrangement information corresponds to a specification of the image forming apparatus 202 (see FIG. 4) in which only one image forming unit 3 is connected. Accordingly, the higher-level apparatus 36 creates driving control data corresponding to this specification, and sends the driving control data to the image forming unit 3.

When the ink color arrangement information received by the higher-level apparatus 36 is Y-Y, M-M, C-C, K-K, the higher-level apparatus 36 determines that the ink color arrangement information corresponds to a specification of the high-speed image forming apparatus 201 (see FIG. 2) in which two image forming units 3 are connected. Accordingly, the higher-level apparatus 36 creates driving control data corresponding to this specification, and sends the driving control data to the image forming units 3.

When the ink color arrangement information received by the higher-level apparatus 36 is Y-Y-M-M, C-C-K-K, S1-S1-S2-S2, the higher-level apparatus 36 determines that the ink color arrangement information corresponds to a specification of the image forming apparatus 204 (see FIG. 6) in which an image forming unit 3 of a special color is connected. Accordingly, the higher-level apparatus 36 creates driving control data corresponding to this specification, and sends the driving control data to the image forming units 3.

When the ink color arrangement information received by the higher-level apparatus 36 is Y-Y-Y-Y, M-M-M-M, C-C-C-C, K-K-K-K, the higher-level apparatus 36 determines that the ink color arrangement information corresponds to a specification of the super high-speed image forming apparatus 205 (see FIG. 7) in which four image forming units 3 are connected. Accordingly, the higher-level apparatus 36 creates driving control data corresponding to this specification, and sends the driving control data to the image forming units 3.

In embodiments of the present invention, the printing speed is divided into three levels, i.e., low speed (for example, 70 m/min.), high speed (for example, 150 m/min.), and super high speed (for example, 210 m/min.).

The sheet feed conveying unit 2 and the sheet eject conveying unit 4 are controlled by the higher-level apparatus 36, and the in feed roller 5 and the out feed roller 18 are controlled so that the web 1 is conveyed at a speed corresponding to each of the specifications.

The image forming apparatus according to an embodiment of the present invention may have various specifications according to the number of connected image forming units 3. The color information of the ink filled in the ink heads 12 does not need to be set in the higher-level apparatus 36 when the image forming apparatus is shipped from the factory or upgraded at the user's site. Accordingly, working hours can be reduced.

In the embodiment illustrated in FIGS. 11 and 12, the information items of the image forming units 3 are separately sent to the higher-level apparatus 36. Thus, each image forming unit 3 has a single output connector, and the higher-level apparatus 36 has plural input connectors (four in the case of FIG. 11) corresponding to the number of connected image forming units 3. The higher-level apparatus 36 can analyze the received information to recognize the ink color arrangement information of the image forming units 3 and the specifications of the image forming apparatus.

The sheet feed conveying unit 2 and the sheet eject conveying unit 4 send, to the higher-level apparatus 36, information pertaining to the web 1 such as information indicating whether the web 1 is present (whether the web 1 is set, whether a paper jam has occurred), information indicating the width size of the web 1, information indicating the thickness of the web 1, information indicating the position (edges) of the web 1 (in the scanning direction), and information indicating the conveying speed of the web 1, as well as error information indicating a failure of the corresponding device or line disconnection.

As described above, each image forming unit 3 only needs to be provided with one connector for outputting information to the higher-level apparatus 36, and therefore the configuration and control circuit are simple and costs can be reduced. Furthermore, the image forming units 3 have the same information transmitting system, and therefore development costs can be reduced.

Sixth Embodiment

Figure 13:
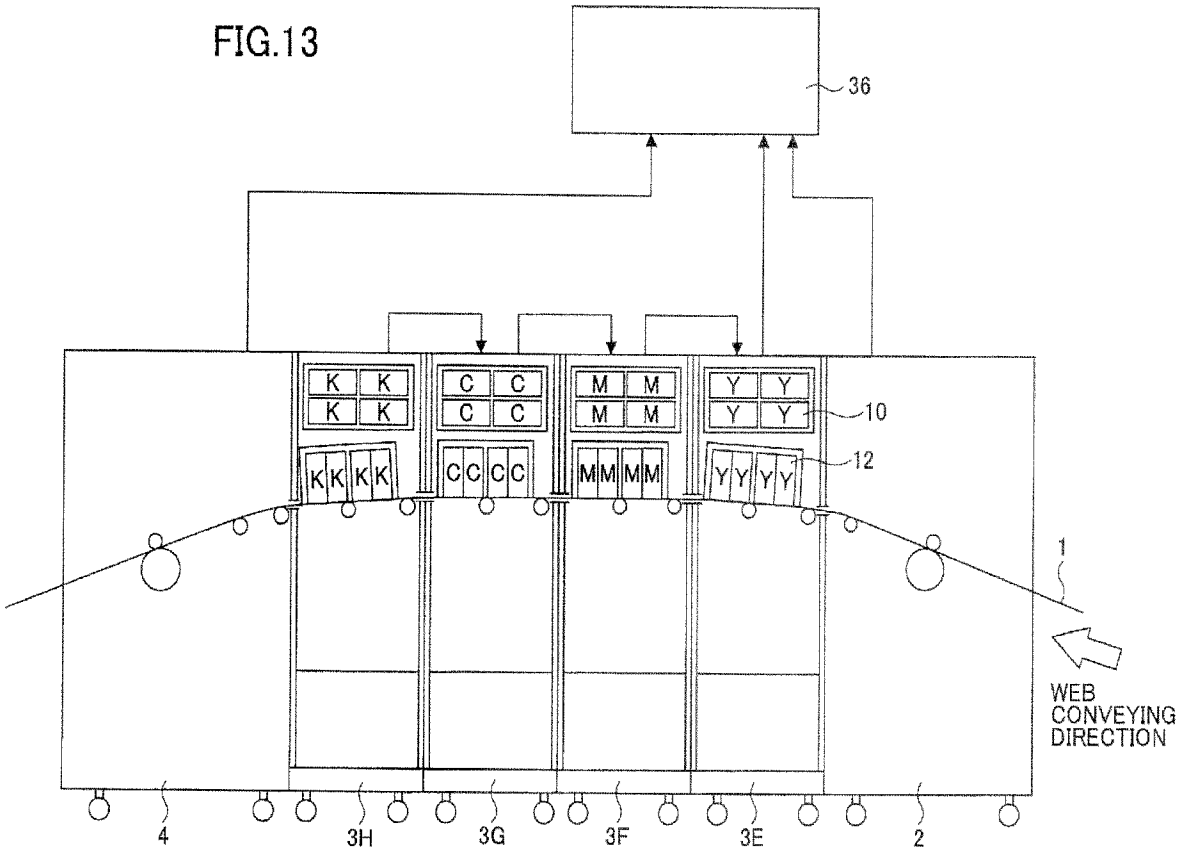
FIG. 13 is a schematic diagram of an image forming apparatus according to a sixth embodiment of the present invention.
Figure 14:
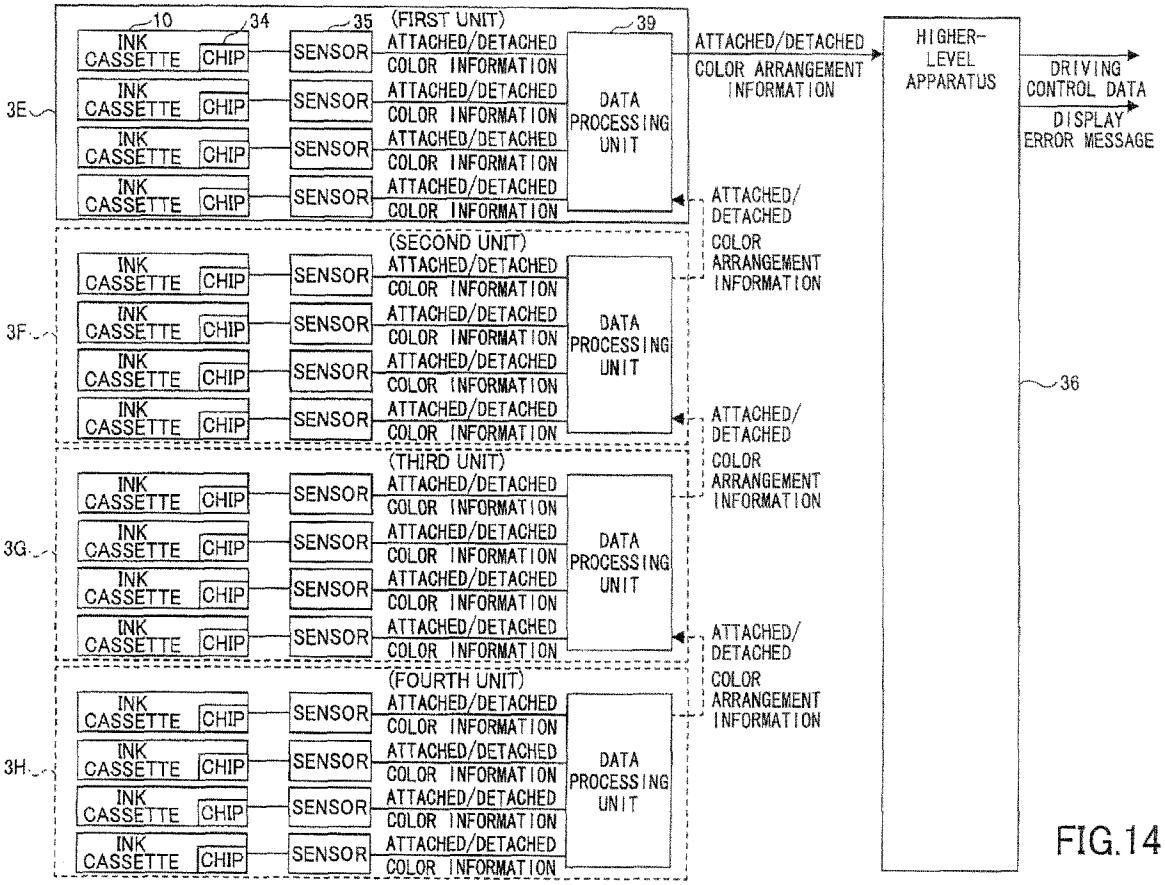
FIG. 14 is a block diagram indicating the relationship between image forming units of the image forming apparatus shown in FIG. 13 and a higher-level device.

FIG. 13 is a schematic diagram of an image forming apparatus according to a sixth embodiment of the present invention. FIG. 14 is a block diagram indicating the relationship between the image forming units and a higher-level device. The difference between the sixth embodiment and the fifth embodiment shown in FIG. 11 is that in the sixth embodiment, the information items of the image forming units 3 are transmitted among the image forming units 3 and collected in one of the image forming units 3. Then, the collected information items are transmitted to the higher-level apparatus 36 from one of the image forming units 3.

In the present embodiment, the information of the image forming unit 3H is sent to the image forming unit 3G, and the image forming unit 3G stores this information in a memory in its data processing unit 39. The image forming unit 3G sends the information of the image forming units 3H and 3G to the image forming unit 3F, and the image forming unit 3F stores this information in a memory in its data processing unit 39. The image forming unit 3F sends the information of the image forming units 3H, 3G, and 3F to the image forming unit 3E, and the image forming unit SE stores this information in a memory in its data processing unit 39. The image forming unit 3E collects all the information including its own, analyzes the information, recognizes attachment/detachment information, color arrangement information, and the specification of the image forming apparatus, and then sends this information to the higher-level apparatus 36.

In the present embodiment, information is sequentially added starting from the image forming unit H, the information is collected in the image forming unit 3E, and the collected information is sent to the higher-level apparatus 36. In another example, at the same time as sending the information of the image forming unit 3H to the image forming unit 3G, the information of the image forming unit SE may be sent to the image forming unit 3F. Then, the image forming unit 3F incorporates the information of itself into the information of the image forming unit 3E and sends this information to the image forming unit 3G. The image forming unit 3G collects the information including the information of itself, and sends the collected information to the higher-level apparatus 36. Accordingly, the information can be sent in a parallel manner.

Seventh Embodiment

Figure 15:
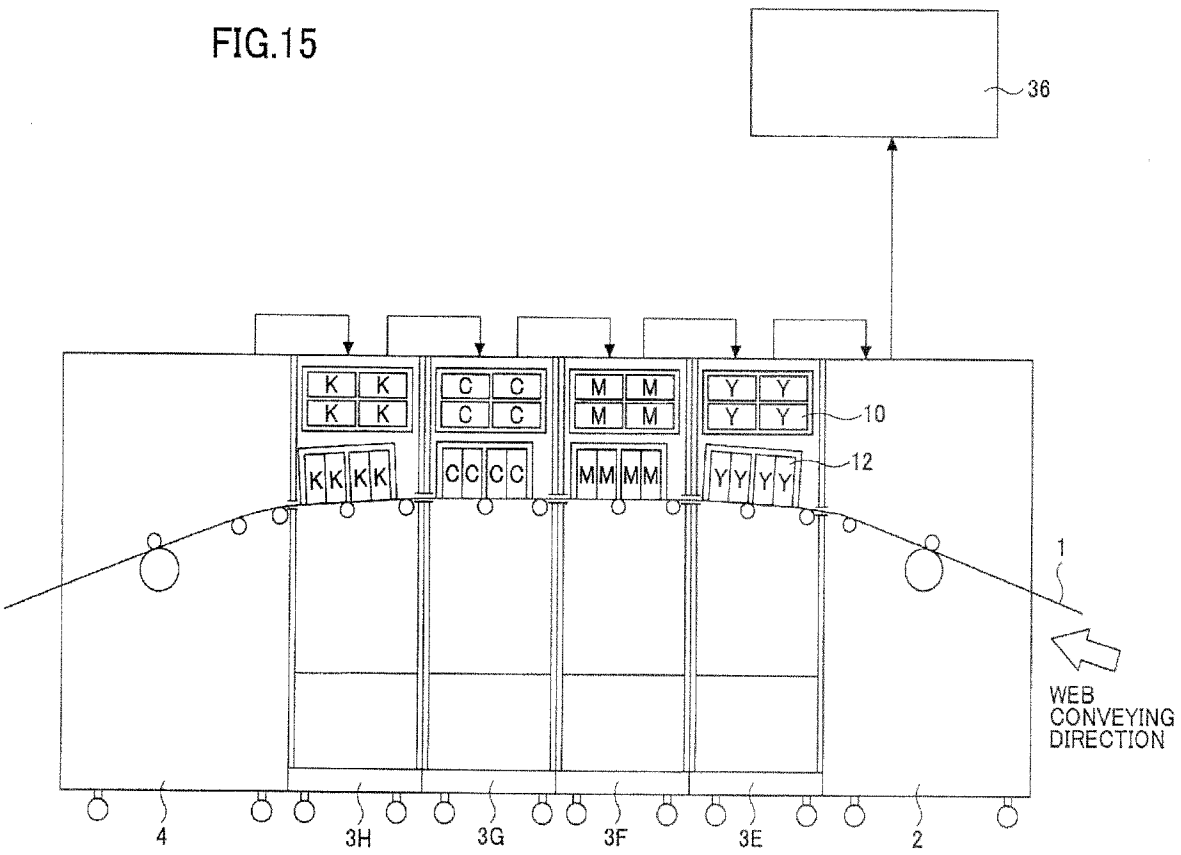
FIG. 15 is a schematic diagram of an image forming apparatus according to a seventh embodiment of the present invention.

FIG. 15 is a schematic diagram of an image forming apparatus according to a seventh embodiment of the present invention. In the present embodiment, the information is sequentially added starting from the sheet eject conveying unit 4 disposed on the far downstream end in the web 1 conveying direction. The information is collected at the sheet feed conveying unit 2 disposed on the far upstream end in the web 1 conveying direction. The collected information is sent to the higher-level apparatus 36.

Transmission of the information is not so limited. For example, the information may be collected in the order of the sheet eject conveying unit 4, the image forming unit 3H, and the image forming unit 3G, and at the same time, the information may be collected in the order of the sheet feed conveying unit 2, the image forming unit 3E, and the image forming unit 3F. Then, the information may be collected at the image forming unit 3F or the image forming unit 3G, and the collected information may be sent, from the image forming unit 3F or the image forming unit 3G to the higher-level apparatus 36. Accordingly, the information can be sent in a parallel manner.

In the sixth and seventh embodiments, information can be sent among the image forming units 3 by providing input/output connecters in each of the image forming units 3 and connecting the connectors with signal lines, or by providing input/output connecters on the side surfaces of each of the image forming units 3 and directly fitting together (inserting) the connectors.

In the sixth and seventh embodiments, test printing can be performed for the purpose of recognizing and determining the specifications of the image forming apparatus, even when there is no higher-level apparatus. Accordingly, maintenance properties can be improved. Furthermore, wires used for sending information can be shortened, thereby reducing cost and eliminating complex wiring.

In the image forming system according to an embodiment of the present invention, the patterns of the ink color arrangement information of the image forming units 3 may correspond to various specifications according to the connected image forming units 3. Thus, predefined color arrangement reference patterns of different specifications (different machine types; are stored in the memory of the higher-level apparatus 36 in advance. Examples of the arrangement reference patterns are Y-M-C-K, Y-Y-M-M, C-C-K-K, Y-Y-Y-Y, M-M-M-M, C-C-C-C, K-K-K-K.

The ink color arrangement information sent from the image forming apparatus is compared with color arrangement reference patterns at the higher-level apparatus 36. When the ink color arrangement information is different from the color arrangement reference patterns, or when the ink cassettes 10 are not attached to the cassette attachment parts 11, an error is displayed (see, for example, FIG. 12) to send a notice to the operator, and the printing operation is automatically stopped.

Accordingly, when the image forming apparatus is shipped from the factory or upgraded at the user's site, it is possible to prevent paper sheets from being wasted as a result of printing errors due to erroneous ink color arrangements (the ink cassettes 10 are attached to wrong positions) or erroneous wiring, and to reduce the time required for recovering from failures. Accordingly, costs can be reduced and the productivity can be enhanced.

Figure 16:
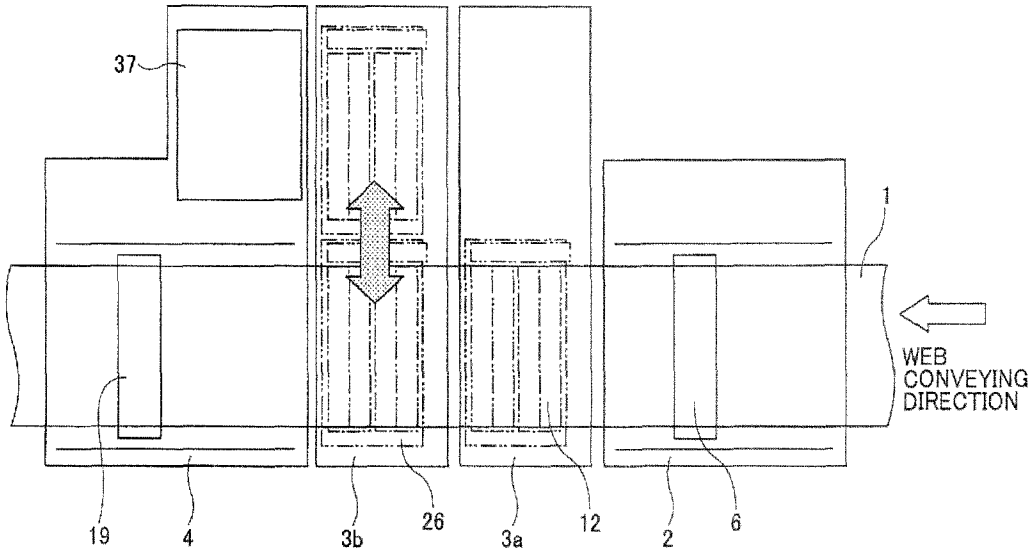
FIG. 16 is a schematic top view and a schematic side view of the image forming apparatus shown in FIG. 10.
Figure 17:
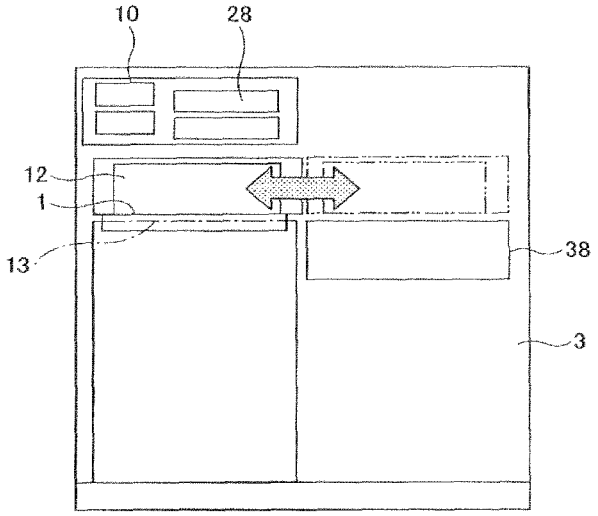
FIG. 17 is a schematic side view of the forming apparatus shown in FIG. 10.
Figure 18:
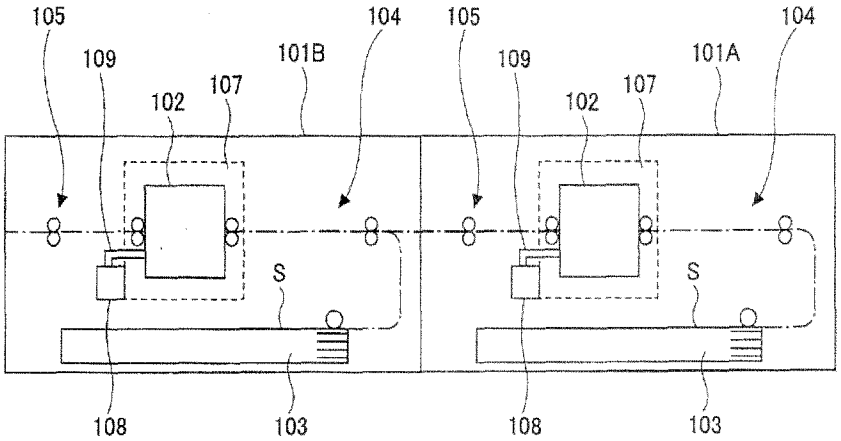
FIG. 18 is a schematic diagram of an image forming apparatus proposed in the conventional technology.
Figure 19:
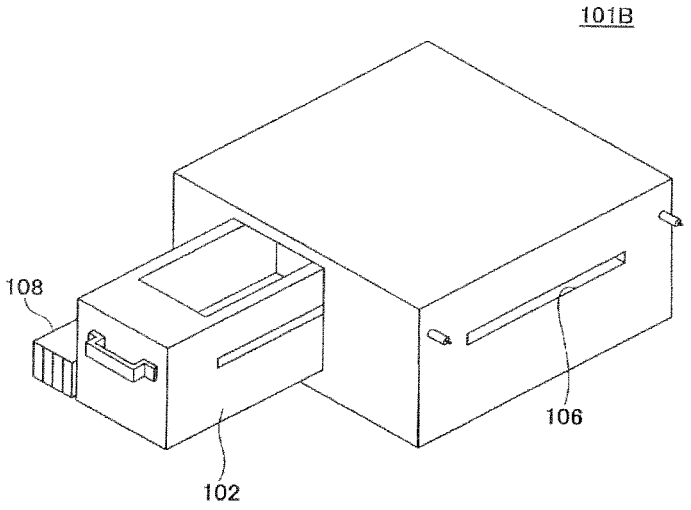
FIG. 19 is a perspective view of the image forming unit included in the image forming apparatus shown in FIG. 19.
Figure 20:
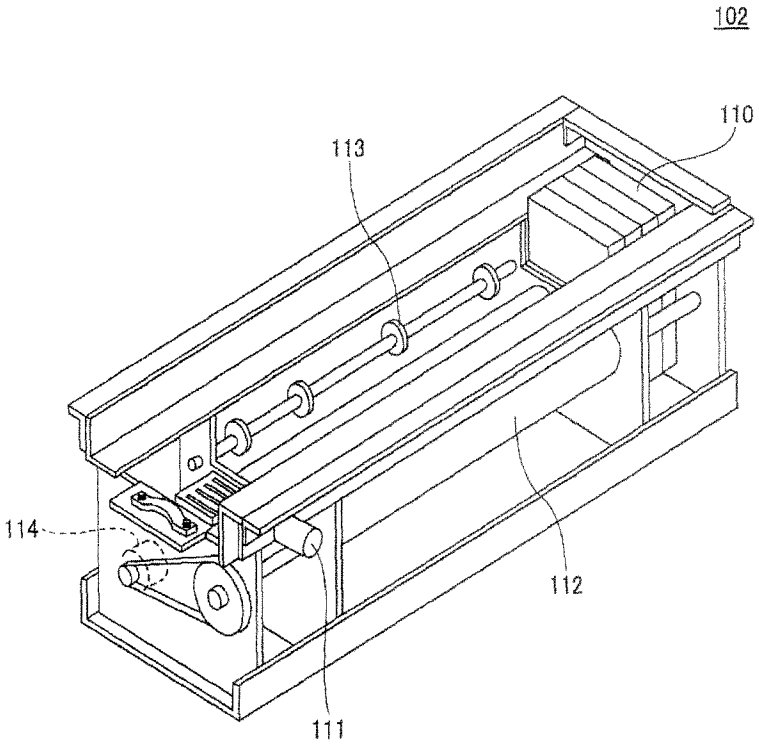
FIG. 20 is a perspective view of an inkjet engine installed in the image forming unit shown in FIG. 19.

FIGS. 16 and 17 respectively show a schematic top view and a schematic side view of the image forming apparatus shown in FIG. 10.

In FIGS. 16 and 17, 37 denotes a power source and 38 denotes a maintenance mechanism provided on the rear side of the image forming apparatus. As indicated by an arrow, the base 26 provided with plural ink heads 12 is configured to move back-and-forth between a printing position facing the web 1 and the platen rollers 13, and a standby position facing the maintenance mechanism 38. When maintenance operations are to be performed for the ink heads 12 (e.g., wiping the ink heads 12 and detecting ink jetting properties), the ink heads 12 (base 26) move toward the maintenance mechanism 33. This configuration is also provided in other image forming apparatuses.

In the above embodiments, regular ink is used in the ink-jet type image forming apparatus; however, the present invention is not so limited. For example, the present invention is also applicable to another type of image forming apparatus, such as an ultraviolet curing ink-jet type image forming apparatus that uses ultraviolet curing type ink. In this case, it is necessary to provide an ultraviolet ray emitting unit for curing the ink by radiating ultraviolet rays toward the downstream side of the ink heads in the web conveying direction.

In the above embodiments, the image forming apparatus forms images on one side of the recording medium such as a web; however, the present invention is not so limited. For example, the present invention is also applicable to an image forming apparatus that forms images on both sides of the recording medium with a reverse mechanism provided on the conveying path of the recording medium such as a web for reversing the recording medium.

In the above embodiments, an ink-jet type image forming apparatus is described; however, the present invention is not so limited. The present invention is also applicable to other image forming apparatuses such as an electrophotographic image forming apparatus.

The present invention is not limited to the specifically disclosed embodiment, and variations and modifications may be made without departing from the scope of the present invention.

The present application is based on Japanese Priority Patent Application No. 2008-281845, filed on Oct. 31, 2008, the entire contents of which are hereby incorporated herein by reference.

What is claimed is:

1. An image forming apparatus comprising:

a sheet feed conveying unit having an outlet for a recording medium on one side;

plural image forming units, each image forming unit including at least one inkjet head filled with ink, an inlet for the recording medium on one side and an outlet for the recording medium on the other side; and a sheet eject conveying unit having an inlet for the recording medium on one side, wherein:

the sheet feed conveying unit, the plural image forming units, and the sheet eject conveying unit are arranged sequentially;

the sheet feed conveying unit, the plural image forming units, and the sheet eject conveying unit are connected to each other in a separable manner;

the recording medium is a long, continuous sheet and is arranged to extend across the sheet feed conveying unit, the plural image forming units, and the sheet eject conveying unit; and a conveyance trajectory of the recording medium extending across the plural image forming units and the sheet eject conveying unit consists of a single arc shape protruding upward.

2. The image forming apparatus according to claim 1, wherein:

the image forming unit comprises platen members provided opposite to the inkjet heads across the recording medium being conveyed; and positions of the platen members can be adjusted in a direction substantially perpendicular to a conveying direction of the recording medium.

3. The image forming apparatus according to claim 1, wherein:

tension is applied to the recording medium while the recording medium is passing through the image forming unit.

4. The image forming apparatus according to claim 1, wherein the conveyance trajectory of the recording medium is formed by the long, continuous sheet rising through the sheet feed conveying unit, including the single arc shape having a middle portion protruding upward through the plural image forming units, and falling through the sheet eject conveying unit.

5. The image forming apparatus according to claim 1, wherein the conveyance trajectory formed by the long, continuous sheet rises from an entry level at an entry side of the sheet feed conveying unit, through the sheet feed conveying unit and to an exit level at an exit side of the sheet feed conveying unit that is higher than the entry level at the entry side of the sheet feed conveying unit, remains throughout conveyance through the plural image forming units and to an entry side of the sheet eject conveying unit above the entry level at the entry side of the sheet feed conveying unit, and falls monotonically through the sheet eject conveying unit.

6. The image forming apparatus according to claim 1, wherein the conveyance trajectory formed by the long, continuous sheet falls monotonically from entry at an entry side of the sheet eject conveying unit, through the sheet eject conveying unit, to exit at an exit side of the sheet eject conveying unit.

7. An image forming apparatus comprising:

a sheet feed conveying unit having an outlet for a recording medium on one side;

plural image forming units, each image forming unit including at least one inkjet head filled with ink, an inlet for the recording medium on one side and an outlet for the recording medium on the other side; and a sheet eject conveying unit having an inlet for the recording medium on one side, wherein:

the sheet feed conveying unit, the plural image forming units, and the sheet eject conveying unit are arranged sequentially;

the sheet feed conveying unit, the plural image forming units, and the sheet eject conveying unit are connected to each other in a separable manner;

the recording medium is a long, continuous sheet and is arranged to extend across the sheet feed conveying unit, the plural image forming units, and the sheet eject conveying unit;

a conveyance trajectory of the recording medium extending across the plural image forming units and the sheet eject conveying unit consists of a single arc shape protruding upward; and in a path where the recording medium extends from the sheet feed conveying unit through the plural image forming units and to the sheet eject conveying unit, the recording medium is guided to pass a higher position at the plural image forming units than that of the sheet feed conveying unit.

8. The image forming apparatus according to claim 7, wherein the conveyance trajectory formed by the long, continuous sheet rises from an entry level at an entry side of the sheet feed conveying unit, through the sheet feed conveying unit and to an exit level at an exit side of the sheet feed conveying unit that is higher than the entry level at the entry side of the sheet feed conveying unit, remains throughout conveyance through the plural image forming units and to an entry side of the sheet eject conveying unit above the entry level at the entry side of the sheet feed conveying unit, and falls monotonically through the sheet eject conveying unit.

9. The image forming apparatus according to claim 7, wherein the conveyance trajectory formed by the long, continuous sheet falls monotonically from entry at an entry side of the sheet eject conveying unit, through the sheet eject conveying unit, to exit at an exit side of the sheet eject conveying unit.

10. The image forming apparatus according to claim 7, wherein in the path where the recording medium extends from the sheet feed conveying unit through the plural image forming units and to the sheet eject conveying unit, the position of the recording medium when passing the plural image forming units is higher than that of the sheet feed conveying unit and that of the sheet eject conveying unit.

11. An image forming apparatus comprising:

a sheet feed conveying unit having an outlet for a recording medium on one side;

plural image forming units, each image forming unit including at least one inkjet head filled with ink, an inlet for the recording medium on one side and an outlet for the recording medium on the other side; and a sheet eject conveying unit having an inlet for the recording medium on one side, wherein:

the sheet feed conveying unit, the plural image forming units, and the sheet eject conveying unit are arranged sequentially;

the sheet feed conveying unit, the plural image forming units, and the sheet eject conveying unit are connected to each other in a separable manner;

the recording medium is a long, continuous sheet and is arranged to extend across the sheet feed conveying unit, the plural image forming units, and the sheet eject conveying unit; and a conveyance trajectory of the recording medium extending across the sheet feed conveying unit and the plural image forming units consists of a single arc shape protruding upward.

* * * * *